US010597947B2

(12) United States Patent
Adams et al.

(10) Patent No.: US 10,597,947 B2
(45) Date of Patent: Mar. 24, 2020

(54) REAMERS FOR EARTH-BORING APPLICATIONS HAVING INCREASED STABILITY AND RELATED METHODS

(71) Applicant: Baker Hughes, a GE company, LLC

(72) Inventors: Nathaniel R. Adams, The Woodlands, TX (US); Mitchell A. Rothe, Montgomery, TX (US); Kendrick D. McGee, Spring, TX (US); Mitchell F. Marks, Youngsville, LA (US)

(73) Assignee: Baker Hughes, a GE company, LLC, Houston, TX (US)

( * ) Notice: Subject to any disclaimer, the term of this patent is extended or adjusted under 35 U.S.C. 154(b) by 69 days.

(21) Appl. No.: 15/983,700

(22) Filed: May 18, 2018

(65) Prior Publication Data

US 2019/0352972 A1 Nov. 21, 2019

(51) Int. Cl.

| | |
|---|---|
| ***E21B 10/32*** | (2006.01) |
| ***E21B 12/00*** | (2006.01) |
| ***E21B 7/28*** | (2006.01) |

(52) U.S. Cl.

CPC ..... *E21B 10/322* (2013.01); *E21B 7/28* (2013.01); *E21B 12/00* (2013.01)

(58) Field of Classification Search

CPC ..... E21B 10/322; E21B 10/32

USPC ..... 175/57

See application file for complete search history.

(56) References Cited

U.S. PATENT DOCUMENTS

| | | | | |
|---|---|---|---|---|
| 4,842,083 | A * | 6/1989 | Raney | E21B 10/43 175/325.4 |
| 6,189,631 | B1 * | 2/2001 | Sheshtawy | E21B 10/32 175/284 |
| 6,971,459 | B2 * | 12/2005 | Raney | E21B 10/43 175/406 |
| 8,020,635 | B2 | 9/2011 | Radford | |
| 8,657,038 | B2 | 2/2014 | Radford et al. | |
| 8,960,333 | B2 | 2/2015 | Radford et al. | |
| 2003/0221873 | A1 | 12/2003 | Beaton | |
| 2004/0134687 | A1 * | 7/2004 | Radford | E21B 10/322 175/57 |
| 2007/0029115 | A1 | 2/2007 | Beaton | |
| 2009/0294178 | A1 | 12/2009 | Radford | |

(Continued)

OTHER PUBLICATIONS

International Search Report for International Application No. PCT/US2019/032822 dated Aug. 29, 2019, 3 pages.

(Continued)

*Primary Examiner* — Taras P Bemko
(74) *Attorney, Agent, or Firm* — TraskBritt

(57) ABSTRACT

Reamer for earth-boring applications may include a body having a longitudinal axis and a blade carried by the body. The blade may include at least one cutting element located at a first radial distance from the longitudinal axis and a gage pad located at a second, smaller radial distance from the longitudinal axis. Methods of enlarging pilot holes in earth formations utilizing reamers may involve removing earth material from a sidewall of the pilot hole utilizing at least one cutting element located at a first radial distance from a longitudinal axis of a body of the reamer on a blade of a reamer. The reamer may be stabilized by placing a gage pad located on the blade in sliding contact with a portion of the sidewall of the pilot hole, the gage pad located at a second, smaller radial distance from the longitudinal axis.

17 Claims, 5 Drawing Sheets

(56) References Cited

U.S. PATENT DOCUMENTS

| | | | | |
|---|---|---|---|---|
| 2010/0089583 | A1* | 4/2010 | Xu | E21B 10/322 166/298 |
| 2010/0276201 | A1 | 11/2010 | Makkar et al. | |
| 2013/0153300 | A1 | 6/2013 | Radford et al. | |
| 2013/0256036 | A1* | 10/2013 | Lyons | E21B 10/32 175/57 |

OTHER PUBLICATIONS

International Written Opinion for International Application No. PCT/US2019/032822 dated Aug. 29, 2019, 7 pages.

* cited by examiner

REAMERS FOR EARTH-BORING APPLICATIONS HAVING INCREASED STABILITY AND RELATED METHODS

FIELD

This disclosure relates generally to earth-boring tools and methods of making and using earth-boring tools. More specifically, disclosed embodiments relate to reamers for earth-boring applications that may increase stability during drilling, which may improve borehole quality, increase earth-boring efficiency, and increase useful lift of earth-boring tools, among other benefits.

BACKGROUND

When deployed in earth-boring applications, reamers are typically used to enlarge a borehole. For example, a drill string may include a so-called "pilot" drill bit at a leading end of the drill string and a reamer trailing behind the drill bit along the drill string. The reamer may include blades fixed at or expandable to an outer diameter greater than the outer diameter of the drill bit, and greater than the outer diameter of the borehole located on the same side of the reamer as the drill bit. In other applications, a reamer may be introduced into an already-formed borehole. The blades may have a cutting structure to engage and cut away earth material from the sidewalls of the borehole, enlarging the diameter of the borehole. The blades of reamers may be, for example, fixed at an outer diameter concentric with or eccentric to the drill bit, or expandable from a retracted position where the outer diameter is at less than or equal to the diameter of the drill bit to an expanded position where the outer diameter is greater than the diameter of the drill bit.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

The illustrations presented in this disclosure are not meant to be actual views of any particular earth-boring tool, reamer, or component thereof, but are merely idealized representations employed to describe illustrative embodiments. Thus, the drawings are not necessarily to scale.

Disclosed embodiments relate generally to reamers for earth-boring applications that may increase stability during drilling, which may improve borehole quality, increase earth-boring efficiency, and increase useful lift of earth-boring tools, among other benefits. More specifically, disclosed are embodiments of blades for reamers for earth-boring applications that may include a first, stabilizing portion having an outer diameter less than an outer diameter of a second, reaming portion of the blades.

As used herein, the terms "substantially" and "about" in reference to a given parameter, property, or condition means and includes to a degree that one of ordinary skill in the art would understand that the given parameter, property, or condition is met with a degree of variance, such as within acceptable manufacturing tolerances. For example, a parameter that is substantially or about a specified value may be at least about 90% the specified value, at least about 95% the specified value, at least about 99% the specified value, or even at least about 99.9% the specified value.

The term "earth-boring tool," as used herein, means and includes any type of bit or tool used for drilling during the formation or enlargement of a wellbore in a subterranean formation. For example, earth-boring tools include fixed-cutter bits, core bits, eccentric bits, bicenter bits, reamers, mills, hybrid bits including both fixed and rotatable cutting structures, and other drilling bits and tools known in the art.

As used herein, the term "earth-boring drill bit" means and includes any type of bit or tool used for drilling during the formation of a wellbore in a subterranean formation. For example, earth-boring tools include fixed-cutter bits, core bits, eccentric bits, bicenter bits, hybrid bits including both fixed and rotatable cutting structures, and other drilling bits known in the art.

The term "gage pad," as used herein, means and includes any component sized, shaped, positioned, and having a durability configured for placement in sliding contact with a sidewall of a borehole in an earth formation. For example, gage pads include outer surfaces of materials integral to a body of a component of an earth-boring tool, separately formed panels of material secured to a body of a component of an earth-boring tool, or materials deposited on a body of a component of an earth-boring tool (e.g., hardfacing). By way of additional example, structures and components configured to remove earthen material, such as, for example, cutting elements, cutting inserts, etc.

Figure 1:
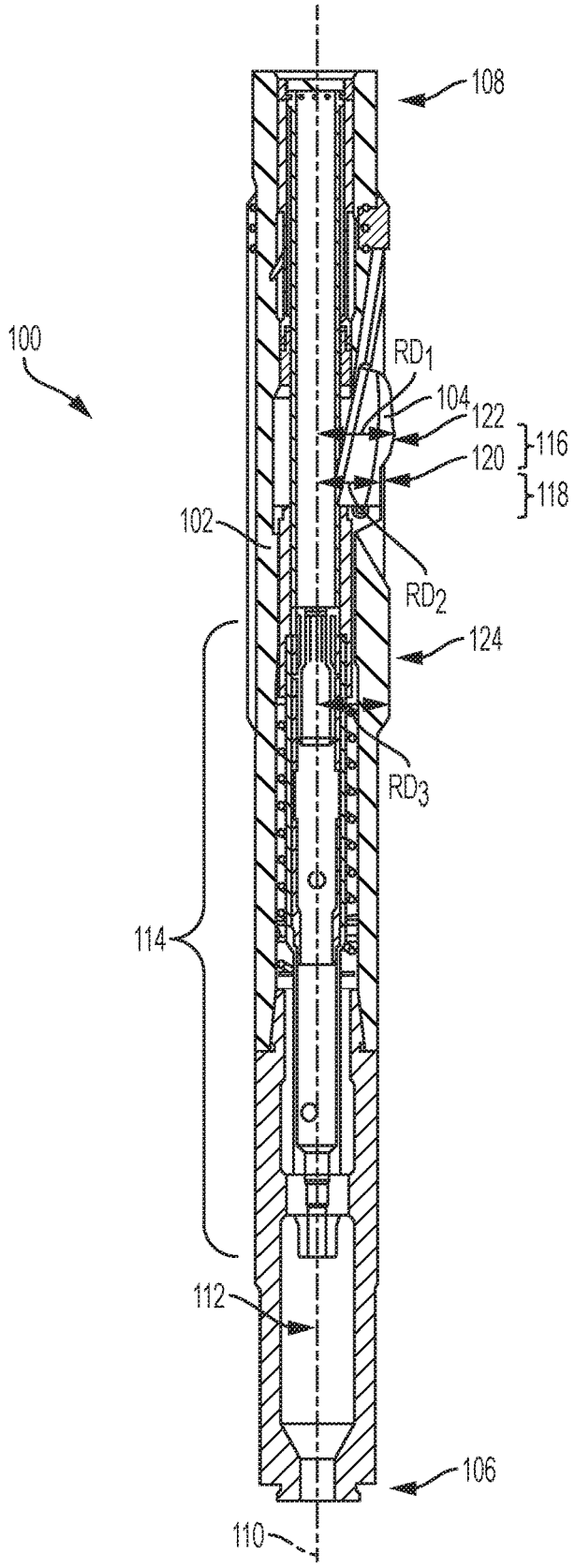
FIG. 1 is an enlarged, partial cross-sectional side view of a reamer for earth-boring applications in a retracted state.

FIG. 1 is an enlarged, partial cross-sectional side view of a reamer 100 for earth-boring applications in a retracted state. The reamer 100 may include, for example, a body 102 and at least one blade 104 carried by the body 102. The body 102 may include a tubular member configured to support other components of the reamer 100 thereon. The body 102 may have a leading end 106 and a trailing end 108, each configured for connection to another component of a drill string, such as, for example, by an American Petroleum Institute (API) standard connection. A longitudinal axis 110 of the body 102 may extend between the leading end 106 and the trailing end 108 proximate an average geometric center of the body 102 from the leading end 106 to the trailing end 108. A passageway 112 may extend axially through the body 102 between the leading end 106 and the trailing end 108 to enable circulating drilling fluid to flow through the reamer 100.

Figure 2:
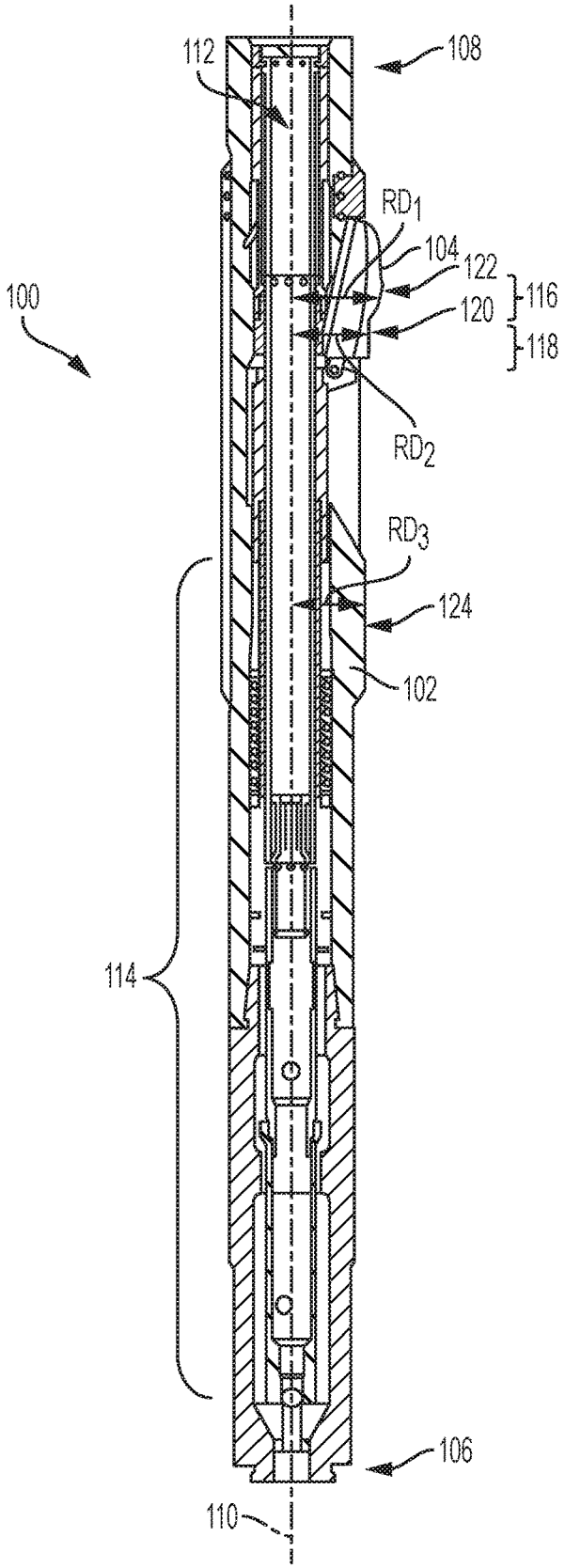
FIG. 2 is an enlarged, partial cross-sectional side view of the reamer of FIG. 1 in an extended state.

In embodiments where the reamer 100 is configured as an expandable reamer, such as that depicted in FIG. 1, the body 102 may support an actuation mechanism 114 configured to move each blade 104 at least from the retracted state shown in FIG. 1 to the extended state shown in FIG. 2, and optionally back to the retracted state and/or back and forth between the retracted state and the extended state. Any actuation mechanism 114 may be employed with reamers 100 having a blade 104 or blades 104 configured in accordance with this disclosure. As a specific, nonlimiting example, the actuation mechanism 114 is shown and described in U.S. Pat. No. 8,960,333, issued Feb. 24, 2015, to Radford et al. Briefly, operation of the actuation mechanism 114 may involve releasing one or more obstructions (e.g., balls) into the circulating drilling fluid, which may lodge into one or more complementary components of the actuation mechanism 114, causing pressure of the drilling fluid to act on and move those components. Movement of the components of the actuation mechanism 114 may cause corresponding movement of the blade 104 or blades 104, enabling extension and/or retraction of the blade 104 or blades 104. In other embodiments, reamers having a blade 104 or blades 104 in accordance with this disclosure may not be expandable (e.g., may be configured as "concentric" reamers or as "eccentric reamers, commonly termed "reamer wings"), having a blade 104 or blades 104 fixed in the extended state depicted in FIG. 2.

The blade 104 or blades 104 supported by the body 102 of the reamer 100 may include a first portion 116 located a first radial distance $RD_1$ from the longitudinal axis 110 greater than a second radial distance $RD_2$ from the longitudinal axis 110 to a second portion 118 of the blade 104 or blades 104. The first radial distance $RD_1$ and the second radial distance $RD_2$ may be measured from the longitudinal axis 110, in a direction at least substantially perpendicular to the longitudinal axis 110, to a radially outermost point on an outer surface 124 of the blade 104 or on a gage pad 120 or cutting element 122 carried by the blade 104. The first portion 116 may be located at a radially outer surface of the blade 104 and may include one or more cutting elements 122 secured to the blade 104 and configured and positioned to engage with, and remove, earth material from a sidewall of the pilot hole to form an enlarged borehole. The second portion 118 may be located at a radially outer surface of the blade 104 and may include one or more gage pads 120 configured and positioned to contact, and slide against, the wall of a pilot hole in an earth formation to stabilize the reamer 100.

The first radial distance $RD_1$ may be, for example, at least about 5% greater than the second radial distance $RD_2$. More specifically, the first radial distance $RD_1$ may be, for example, between about 10% and about 50% greater than the second radial distance $RD_2$. As a specific, nonlimiting example, the first radial distance $RD_1$ may be, for example, between about 15% and about 40% greater than the second radial distance $RD_2$ (e.g., about 20% greater, about 25% greater, or about 30% greater).

When the blade 104 or blades 104 are in the retracted state, at least the second portion 118 may be located within a radial extent of the body 102. For example, a third radial distance $RD_3$ from the longitudinal axis 110 to a radially farthest point on the outer surface 124 of the body 102 may be greater than the second radial distance $RD_2$. More specifically, the first portion 116 and the second portion 118 may be located within the radial extent of the body 102. As a specific, nonlimiting example, the third radial distance $RD_3$ from the longitudinal axis 110 to the radially farthest point on the outer surface 124 of the body 102 may be greater than the first radial distance $RD_1$ and the second radial distance $RD_2$. Keeping at least a portion, or an entirety, of the blade 104 or blades 104 within the radial extent of the body 102 while the reamer 100 is in the extended state may enable the reamer to be tripped into a borehole (e.g., through a casing or liner string lining a borehole) while reducing the likelihood that the blade 104 or blades 104, including the gage pad 120 or gage pads 120 and the cutting element 122 or cutting elements 122 thereof, may undesirably contact the sidewall of the borehole.

FIG. 2 is an enlarged, partial cross-sectional side view of the reamer 100 of FIG. 1 in an extended state. When the actuation mechanism 114 is activated, the blade 104 or blades 104 may extend radially outward from the retracted state depicted in FIG. 1 toward a radially outermost position in the extended state depicted in FIG. 2. When the reamer 100 is in the extended state, the first radial distance $RD_1$ from the longitudinal axis 110 of the body 102 to the first portion 116 of the blade 104 may be greater than the first radial distance $RD_1$ was when the reamer 100 was in the retracted state. The second radial distance $RD_2$ from the longitudinal axis 110 of the body 102 to the second portion 118 of the blade 104 may likewise be greater than the second radial distance $RD_2$ was when the reamer 100 was in the retracted state. The second radial distance $RD_2$ may remain less than the first radial distance $RD_1$ in both the retracted state and the extended state.

When the blade 104 or blades 104 are in the extended state, at least a section of the first portion 116 may be located radially beyond the radial extent of the body 102. For example, the third radial distance $RD_3$ from the longitudinal axis 110 to the radially farthest point on the outer surface 124 of the body 102 may be less than the first radial distance $RD_1$. More specifically, an entirety of the first portion 116 may be located beyond the radial extent of the body 102 and the second portion 118 may be located radially beyond, or at least substantially flush with, the radial extent of the body 102. As a specific, nonlimiting example, the third radial distance $RD_3$ from the longitudinal axis 110 to the radially farthest point on the outer surface 124 of the body 102 may be less than the first radial distance $RD_1$ and the second radial distance $RD_2$. When the blade 104 or blades 104 are in the extended state, the first portion 116 may be positioned to engage with, and cut away, earth material from the sidewall of a pilot hole to form an enlarged borehole and the second portion 118 may be positioned to contact, and slide against, the sidewall of the pilot hole to stabilize the reamer.

Figure 3:
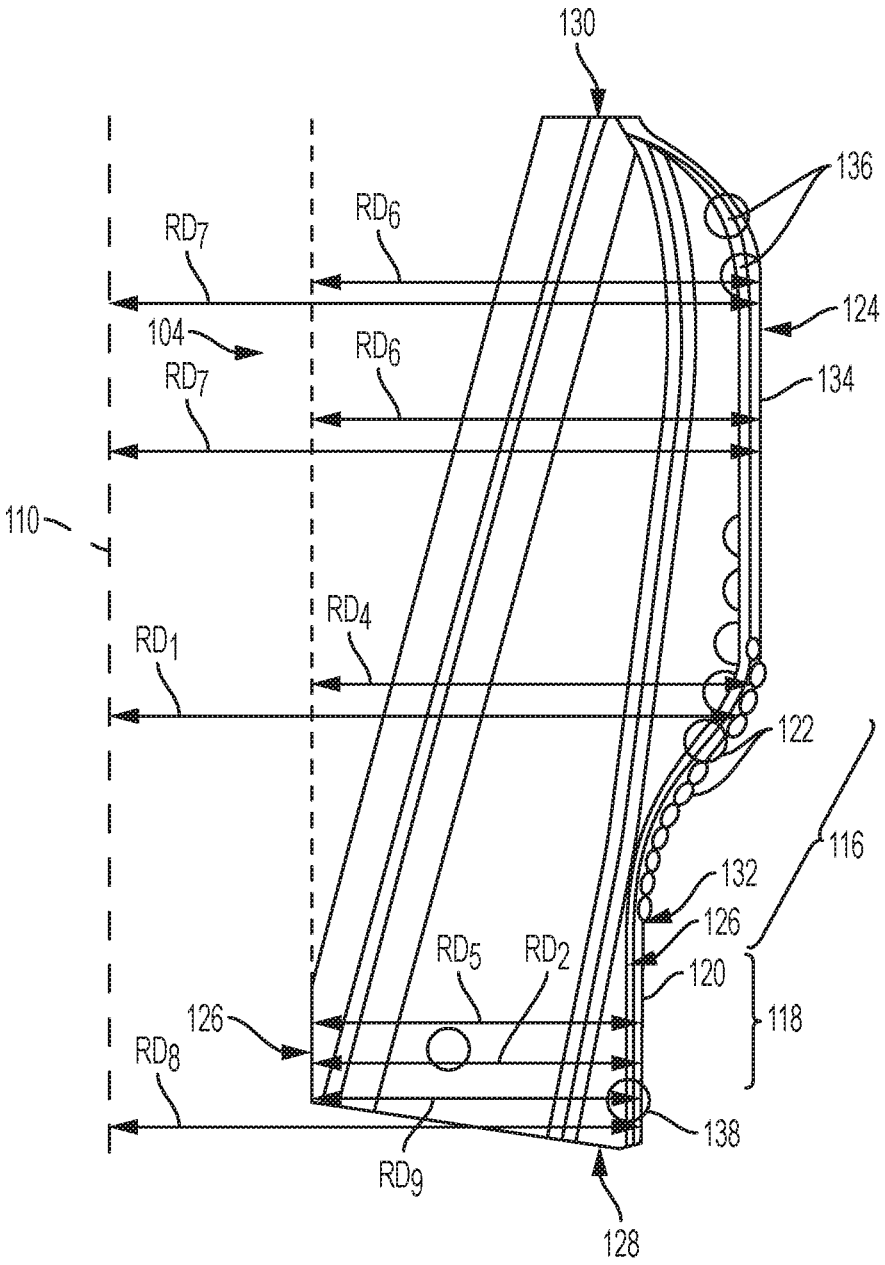
FIG. 3 is an enlarged side view of a blade of the reamers of FIGS. 1 and 2.

FIG. 3 is an enlarged side view of a blade 104 of the reamer 100 of FIGS. 1 and 2. The blade 104 may include an inner surface 126 located on a side of the blade 104 opposite the outer surface 124, and configured to be positioned proximate the longitudinal axis 110 when the blade 104 is installed in a reamer 100 (see FIGS. 1, 2). The inner surface 126 may be sloped, such that the inner surface 126 at an axially leading end 128 of the blade 104 is located radially farther from the first portion 116 and the second portion 118 than the inner surface 126 at an axially trailing end 130 of the blade 104. A fourth radial distance $RD_4$ between the inner surface 126 at the axially leading end 128 of the blade 104 and the first portion 116 may be greater than a fifth radial distance $RD_5$ between the inner surface 126 at the axially leading end 128 of the blade 104 and the second portion 118. The fourth radial distance $RD_4$ and the fifth radial distance $RD_5$ may be measured from the inner surface 126 at the axially leading end 128 of the blade 104, in a direction at least substantially normal to a direction of intended rotation of the blade 104, to a radially outermost point on an outer surface 124 of the blade 104 or on a gage pad 120 or cutting element 122 carried by the blade 104.

The fourth radial distance $RD_4$ may be, for example, about at least about 5% greater than the fifth radial distance $RD_5$. More specifically, the fourth radial distance $RD_4$ may be, for example, between about 10% and about 60% greater than the fifth radial distance $RD_5$. As a specific, nonlimiting example, the fourth radial distance $RD_4$ may be, for example, between about 15% and about 50% greater than the fifth radial distance $RD_5$ (e.g., about 20% greater, about 30% greater, or about 40% greater).

As shown in FIG. 3, the first portion 116 may be located axially adjacent to the second portion 118, such that the stabilization enabled by the first portion 116 may be located axially closer to the borehole enlargement enabled by the second portion 118, when compared to conventional solutions for stabilizing earth-boring reamers. For example, an axial border 132 between the first portion 116 and the second portion 118 may be formed by a first cutting element 122 of the first portion 116 located axially above a gage pad 120 of the second portion 118 or a change in direction of the outer surface 124 from at least substantially parallel to a direction of intended advancement of the blade 104 during reaming to an oblique angle with the direction of intended advancement of the blade 104. The gage pad 120 may be located on an axial side of the cutting element 122 configured to be located closer to an earth-boring drill bit than the cutting element 122 when blade 104 is installed in a reamer 100 (see FIGS. 1, 2) and the reamer 100 (see FIGS. 1, 2) is connected to a drill string.

To better facilitate enlarging the pilot hole against the wall of which the gage pad 120 of the second portion 118 may slide, the cutting elements 122 of the first portion 116 may be arranged in a group having maximum radial exposures above the outer surface 124 of the blade 104 located between the first radial distance $RD_1$ and the second radial distance $RD_2$. The group of cutting elements 122 may collectively form a cutting profile shaped and positioned to progressively remove earth material from the sidewall of a pilot hole radially outward to form an enlarged borehole.

In some embodiments, such as that shown in FIG. 3, the blade 104 may include another gage pad 134 located at a sixth radial distance $RD_6$ farther from the inner surface 126 than the fifth radial distance $RD_5$, and at a seventh radial distance $RD_7$ farther from the longitudinal axis 110 than the second radial distance $RD_2$. The sixth radial distance $RD_6$ may be, for example, at least substantially equal to, or less than, the fourth radial distance $RD_4$, and the seventh radial distance $RD_7$ may be, for example, at least substantially equal to, or less than, the first radial distance $RD_1$. The other gage pad 134 may be configured and positioned to contact, and slide against, a sidewall of an enlarged borehole formed by the cutting elements 122 of the first portion 116 to stabilize the reamer 100 when enlarging the pilot hole. The other gage pad 134 may be located on an axial side of the first portion 116 and its associated cutting elements 122 opposite a side on which the second portion 118 and its associated gage pad 120 are located, such that the cutting elements may be located axially between the gage pad 120 at the second radial distance $RD_2$ and the other gage pad 134 at the seventh radial distance $RD_7$.

In some embodiments, such as that shown in FIG. 3, the blade 104 may include at least another cutting element 136 located on an axial side of the other gage pad 134 at the seventh radial distance $RD_7$ opposite an axial side on which the cutting elements 122 at the fifth radial distance $RD_5$ are located. The other cutting element 136 or cutting elements 136 secured to the blade 104 may be positioned, oriented, and configured to engage with, and remove, earth material from a sidewall of the pilot hole or of the enlarged borehole to form an enlarged borehole when back-reaming or to reduce the likelihood that unintended contact with the sidewall of the enlarged borehole will cause the reamer 100 (see FIGS. 1, 2) to become jammed or otherwise stuck in the borehole. For example, the reamer 100 (see FIGS. 1, 2) may be placed into a pilot hole in an earth formation in a retracted state, tripped beyond a casing lining the pilot hole, placed in an extended state to cause the other cutting elements 136 to contact the sidewall of the pilot hole, and rotated while moving the reamer 100 (see FIGS. 1, 2) back toward the surface. The other cutting elements 136 may remove earth material from the sidewall of the pilot hole to form an enlarged borehole. As another example, the cutting elements 122 of the reamer 100 (see FIGS. 1, 2) may be used to enlarge a borehole while the blades 104 are in the extended state, the blades 104 may remain in an extended state, and the reamer 100 (see FIGS. 1, 2) may be rotated while moving back toward the surface. The other cutting elements 136 may remove earth material from the sidewall of the enlarged borehole to reduce the risk of jamming.

In some embodiments, such as that shown in FIG. 3, the blade 104 may include still another cutting element 138 located on an axial side of the gage pad 120 opposite the cutting elements 122 located at the first radial distance $RD_1$ from the longitudinal axis 110. The one or more other cutting elements 138 may be located at an eighth radial distance $RD_8$ closer to the longitudinal axis 110 than the first radial distance $RD_1$, and a ninth radial distance $RD_9$ closer to the inner surface 126 than the fourth radial distance $RD_4$. More specifically, the eighth radial distance $RD_8$ at which the other cutting elements 138 are located from the longitudinal axis 110 may be at least substantially equal to, or greater or less than, the second radial distance $RD_2$ at which the gage pad 120 is located from the longitudinal axis 110 and less than the first radial distance $RD_1$ at which the cutting elements 122 associated with the first portion 116 are located from the longitudinal axis 110. The other cutting element 138 or cutting elements 138 secured to the blade 104 may be positioned, oriented, and configured to engage with, and remove, earth material from a sidewall of the pilot hole to reduce the likelihood that unintended contact with the sidewall of the pilot hole will cause the reamer 100 (see FIGS. 1, 2) to become jammed or otherwise stuck in the borehole. For example, the cutting elements 122 of the reamer 100 (see FIGS. 1, 2) may be used to enlarge a borehole while the blades are in the extended state, and the other cutting elements 138 may remove earth material from the sidewall of the pilot hole to reduce the risk of jamming while the gage pad 120 stabilizes the reamer by being placed in sliding contact with the sidewall of the pilot hole.

The blade 104, and its various components, may be made from materials suitable for use in the downhole environment. For example, the blade 104 and its components may include steel and/or metallic-ceramic composite materials (i.e., cermets). More specifically, the blade 104 may include a steel alloy or a metal- or metal-alloy-bound tungsten carbide particle-matrix composite material, and may be formed by casting or forging of the metal or metal alloy, infiltration of ceramic particles utilizing a metal matrix material, or other manufacturing processes known in the art. The gage pads 120 and the other gage pads 134 may include, for example, hardfacing material (i.e., abrasion-resistant particles bound in a metal or metal-alloy matrix material) and/or metallic-ceramic composite materials, and may be deposited on, or separately formed and attached to, the relevant surfaces and locations on the blade 104 by welding or other processes known in the art. The cutting elements 122, other cutting elements 136, and still other cutting elements 138 may include a unitary body of material or a substrate with a cutting table secured to an end of the substrate, and may be placed within pockets formed in the blades 104 and secured thereto (e.g., by a weld or braze), may be cast into the pockets during formation of the blades 104, or attached to the blades 104 by other processes known in the art.

Figure 4:
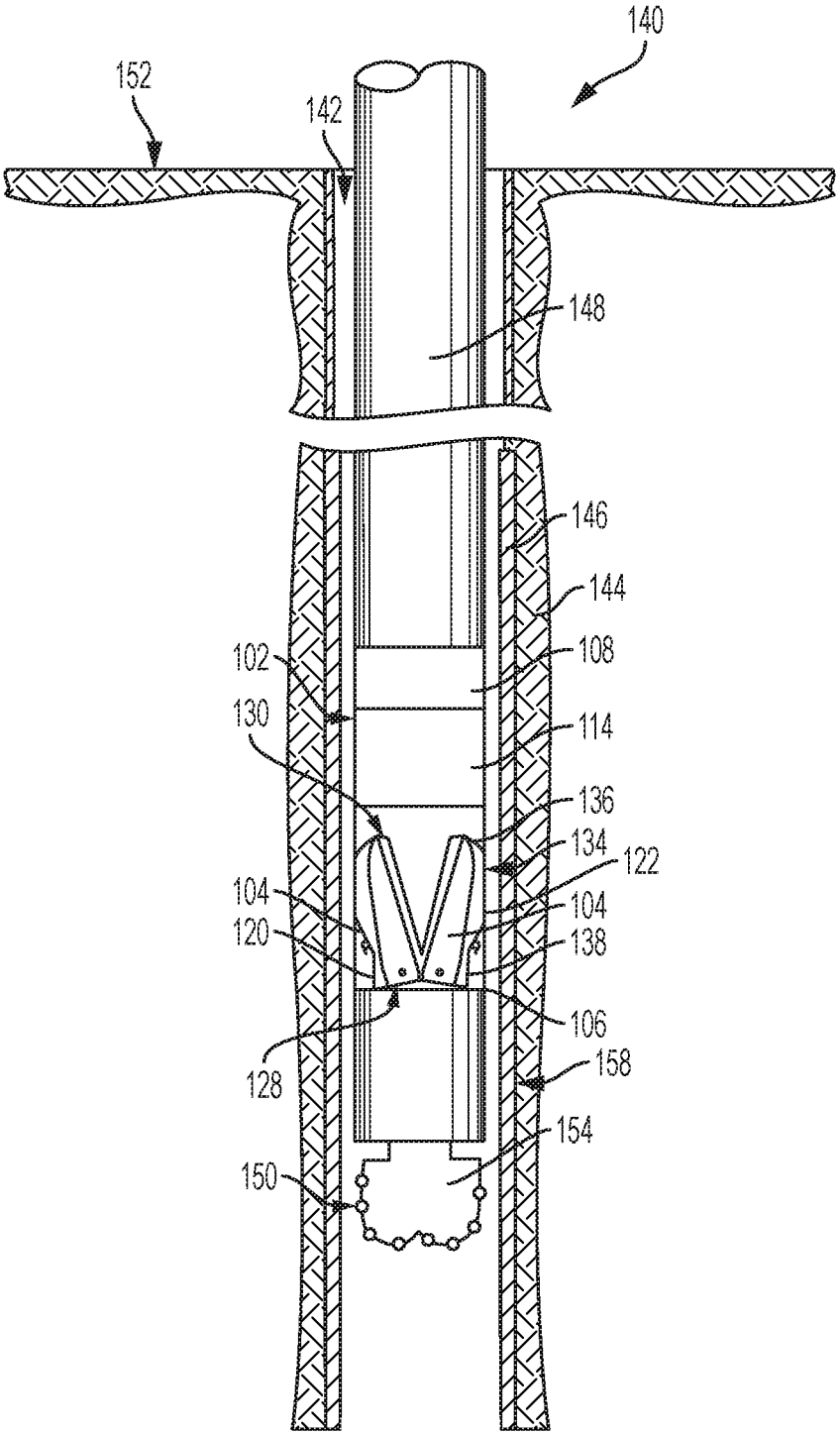
FIG. 4 is a partial cross-sectional, schematic side view of a drill string including the reamer of FIG. 1 in the retracted state.

FIG. 4 is a partial cross-sectional, schematic side view of a drill string 140 including the reamer 100 of FIG. 1 in the retracted state. When using the reamer 100 to enlarge a pilot hole 142, the drill string 140 may be lowered into the earth formation 144. In the embodiment shown in FIG. 4, the pilot hole 142 has been preformed, and is lined with a casing 146 that the drill string is moved through. In other embodiments, the pilot hole may be formed concurrently during reaming and enlargement of the pilot hole to form an enlarged borehole. The drill string 140 may include, for example, one or more sections of drill pipe 148, the reamer 100 located between a leading end 150 of the drill string 140 and the surface 152, and an earth-boring drill bit 154 located at the leading end 150 of the drill string 140.

When the reamer 100 is in the retracted state, at least a portion, and up to an entirety, of each blade 104 may be located within the radial confines of the body 102. More specifically, at least the cutting elements 138 located at the axially leading end 128 of the blades 104, the gage pads 120 located axially adjacent to the cutting elements 138 on the blades 104 and at least some of the cutting elements 122 located axially adjacent to the gage pads 120 on an axial side of the gage pads 120 opposite the axially leading end 128 may be located radially within the outer surface of the body 102. In some embodiments, all of the cutting elements 122 located axially adjacent to the gage pads 120, the other gage pads 134 located axially adjacent to the cutting elements 122 on an axial side of the cutting elements 122 opposite the gage pads 120, and the other cutting elements 136 located adjacent to the other gage pads 134 on an axial side of the other gage pads 134 opposite the cutting elements 122 proximate the axially trailing end 130 of the blade may be located radially within the body 102.

While in the retracted state, the drill string 140, including the earth-boring drill bit 154 and the reamer 100 may be advanced to a desired position within the pilot hole 142. For example, the drill string 140 may be advanced into the pilot hole 142 until at least the reamer 100 has advanced beyond a distal end of the casing 146.

Figure 5:
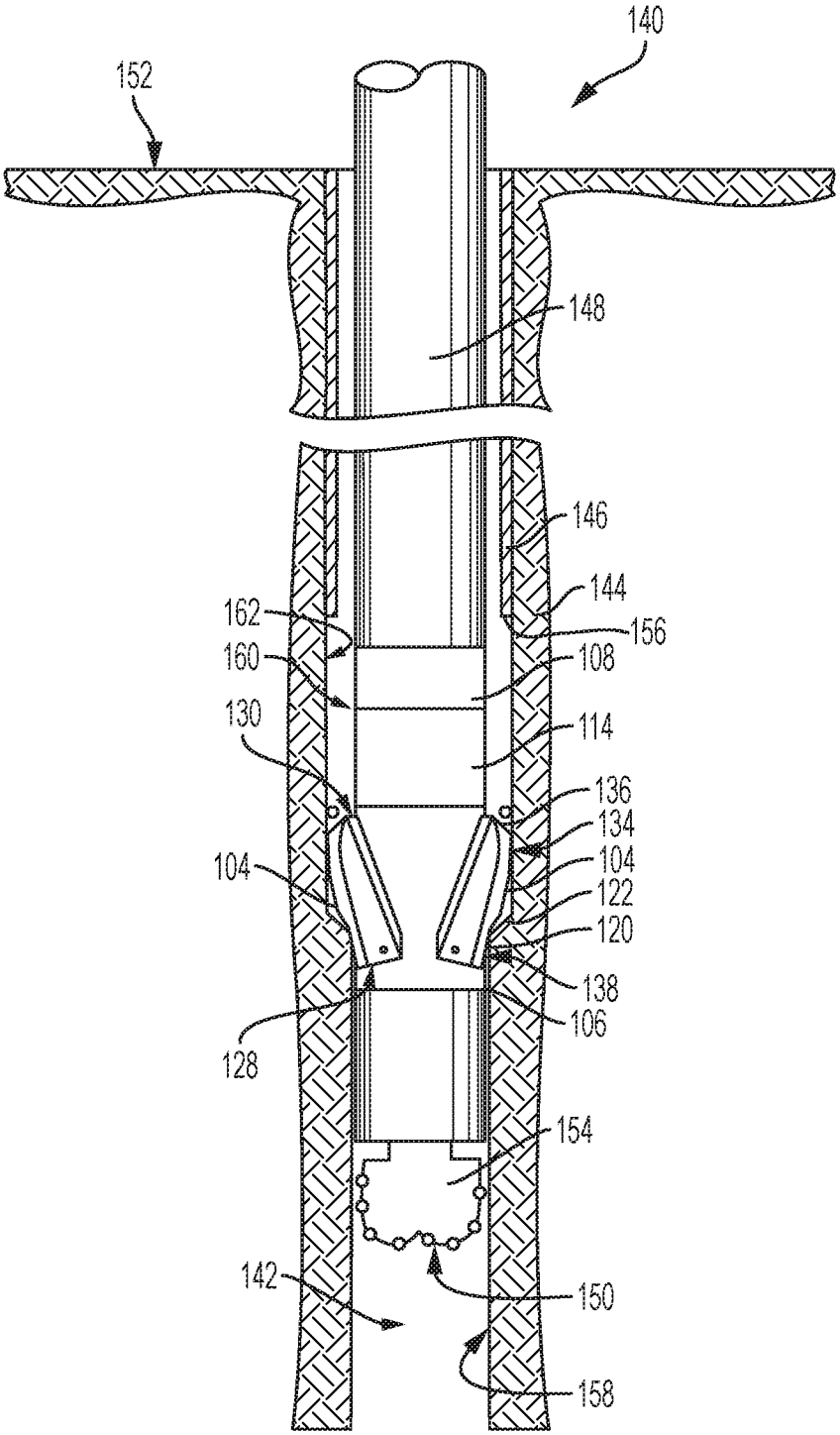
FIG. 5 is a partial cross-sectional, schematic side view of the drill string of FIG. 4 with the reamer in an extended state.

FIG. 5 is a partial cross-sectional, schematic side view of the drill string 140 of FIG. 4 with the reamer 100 in an extended state. The reamer 100 may be placed in the extended state, for example, after the reamer 100 has been positioned beyond a distal end 156 of the casing 146, or simply after the reamer 100 has entered the pilot hole 142 in embodiments where enlargement occurs concurrently with formation of the pilot hole 142. When the reamer 100 is placed in the extended state, the cutting elements 122 may engage with, and remove earth material from, sidewall 158 of the pilot hole 142. A radially outermost one of the cutting elements 122, which may be define the fourth radial distance $RD_4$ and the fifth radial distance $RD_5$ (see FIG. 3), may be the first feature of the blade 104 to contact the sidewall 158 of the pilot hole 142 when transitioning from the retracted state to the extended state. The cutting elements 122 may cooperatively increase the diameter of the pilot hole 142 to form an enlarged borehole 160.

The reamer 100 may be stabilized against the sidewall 158 of the pilot hole 142 by the gage pads 120. For example, extension of the blades 104 to the extended state may bring the gage pads 120 into sliding contact with the sidewall 158 of the pilot hole 142. As the drill string 140 is rotated, causing the reamer 100 to rotate within the pilot hole 142 and the enlarged borehole 160, the non-aggressive contact between the gage pads 120 and the sidewall 158 of the pilot hole 142 may reduce vibrations and non-concentric rotation of the drill string 140. Because the gage pads 120 are located closer to the body 102 of the reamer 100 than the cutting elements 122, particularly when the blades 104 are in the extended state, the gage pads 120 may come into contact with the sidewall 158 of the pilot hole 142 after the cutting elements 122 as the blades 104 move from the retracted state to the extended state.

In embodiments where the blades 104 include the other gage pads 134, the reamer 100 may be further stabilized against the sidewall 162 of the enlarged borehole 160 by the other gage pads 134. For example, extension of the blades 104 to the extended state may bring the other gage pads 134 into sliding contact with the sidewall 162 of the enlarged borehole 160. As the reamer 100 rotates within the pilot hole 142 and the enlarged borehole 160, the non-earth-removing contact between the other gage pads 134 and the sidewall 162 of the enlarged borehole 160 may further reduce vibrations and non-concentric rotation of the drill string 140. Because the other gage pads 120 are located farther from the body 102 of the reamer 100 than the gage pads 120, particularly when the blades 104 are in the extended state, the other gage pads 134 may come into contact with the sidewall 162 of the enlarged borehole 160 before the gage pads 120 come into contact with the sidewall 158 of the pilot hole 142 (e.g., between when the cutting elements 122 contact the sidewall 158 and the gage pads 120 contact the sidewall 158) as the blades 104 move from the retracted state to the extended state.

In embodiments where the blades 104 include the other cutting elements 136, the other cutting elements 136 may be used to back-ream the pilot hole 142, to reduce the risk of jamming while the reamer 100 is removed from the enlarged borehole 160, or both. For example, extension of the blades 104 to the extended state may bring the other cutting elements 136 into cutting engagement with the sidewall 158 of the pilot hole 142. As the reamer 100 rotates within the pilot hole 142 during back-reaming, or within the enlarged borehole 160 during extraction, and the reamer 100 is moved closer to the surface 152, the aggressive contact between the other cutting elements 136 and the sidewall 158 of the pilot hole 142 may remove earth material from the sidewall 158 of the pilot hole 142 to form the enlarged borehole 160 (e.g., between where the blades 104 are moved to the extended state and the distal end 156 of the casing 146), or from the sidewall 162 of the enlarged borehole 160 to reduce the risk of jamming. Because the other cutting elements 136 are located farther from the body 102 of the reamer 100 than the gage pads 120, particularly when the blades 104 are in the extended state, the other cutting elements 136 may come into contact with the sidewall 162 of the enlarged borehole 160 before the gage pads 120 come into contact with the sidewall 158 of the pilot hole 142 (e.g., at least substantially at the same time as, or after, the cutting elements 122 contact the sidewall 158) as the blades 104 move from the retracted state to the extended state.

In embodiments where the blades 104 include the still other cutting elements 138, the still other cutting elements 138 may be used to reduce the risk of jamming while the reamer 100 is advanced into the pilot hole 142. For example, extension of the blades 104 to the extended state may bring the still other cutting elements 138 into cutting engagement with the sidewall 158 of the pilot hole 142. As the reamer 100 rotates within the pilot hole 142 and the enlarged borehole 160, the earth-removing contact between the still other cutting elements 138 and the sidewall 158 of the pilot hole 142 may remove earth material from the sidewall 158 of the pilot hole 142 to reduce the risk of jamming. Because the still other cutting elements 138 are located closer to the body 102 of the reamer 100 than the cutting elements 122, particularly when the blades 104 are in the extended state, the still other cutting elements 138 may come into contact with the sidewall 158 of the pilot hole 142 after the cutting elements 122 come into contact with the sidewall 158 of the pilot hole 142 (e.g., at least substantially at the same time as, before, or after the gage pads 120 come into contact with the sidewall 158 of the pilot hole 142) as the blades 104 move from the retracted state to the extended state.

By placing the gage pads 120 on the blades 104 of the reamer 100 themselves, positioning, the gage pads 120 axially proximate to (e.g., directly axially adjacent to) the cutting elements 122 used to enlarge the pilot hole 142, and otherwise configuring the gage pads 120 to stabilize the blades 104 against the pilot hole 142, the gage pads 120 may better stabilize the reamer 100. Stability during earth-boring operations in general, and reaming in particular, provides many benefits, including reducing wear on the components of the drill string 140, reduced energy input per unit of distance traveled downhole, and improved quality of the enlarged borehole 160 (e.g., smoother sidewalls 162, reduced risk of collapse, etc.).

Additional, nonlimiting embodiments within the scope of this disclosure include the following:

Embodiment 1: A reamer for earth-boring applications, comprising: a body having a longitudinal axis; and a blade carried by the body, the blade comprising: at least one cutting element located at a first radial distance from the longitudinal axis; and a gage pad located at a second, smaller radial distance from the longitudinal axis.

Embodiment 2: The reamer of Embodiment 1, wherein the gage pad is located on an axial side of the at least one cutting element configured to be located closer to an earth-boring drill bit than the at least one cutting element when the reamer is connected to a drill string.

Embodiment 3: The reamer of Embodiment 1 or Embodiment 2, further comprising another gage pad located at a third radial distance farther from the longitudinal axis than the second radial distance.

Embodiment 4: The reamer of Embodiment 3, wherein the gage pad is positioned and configured to contact, and slide against, a sidewall of a pilot hole and the other gage pad is positioned and configured to contact, and slide against, a sidewall of an enlarged borehole.

Embodiment 5: The reamer of Embodiment 3, wherein the at least one cutting element is located axially between the gage pad at the second radial distance and the other gage pad at the third radial distance.

Embodiment 6: The reamer of Embodiment 5, further comprising another cutting element located on an axial side of the other gage pad at the third radial distance opposite the at least one cutting element at the first radial distance.

Embodiment 7: The reamer of any one of Embodiments 1 through 6, further comprising another cutting element located on an axial side of the gage pad opposite the at least one cutting element located at the first radial distance from the longitudinal axis, the other cutting element located at a third radial distance closer to the longitudinal axis than the first radial distance.

Embodiment 8: The reamer of any one of Embodiments 1 through 7, wherein the first radial distance is at least about 5% greater than the second radial distance.

Embodiment 9: The reamer of any one of Embodiments 1 through 8, wherein the blade is extensible from the body and retractable toward the body and the at least one cutting element does not extend beyond the body when the blade is in a fully retracted state.

Embodiment 10: The reamer of any one of Embodiments 1 through 9, wherein the at least one cutting element comprises a group of cutting elements having maximum radial exposures located between the first radial distance and the second radial distance.

Embodiment 11: An earth-boring tool, comprising: an earth-boring drill bit comprising a gage region proximate an outer diameter of the earth-boring drill bit; and a reamer connected to the earth-boring drill bit, the reamer comprising: a body having a longitudinal axis; and a blade carried by the body, the blade comprising: at least one cutting element located at a first radial distance from the longitudinal axis; and a gage pad located at a second, smaller radial distance from the longitudinal axis, the second radial distance being at least substantially equal to the outer diameter of the earth-boring drill bit.

Embodiment 12: The earth-boring tool of Embodiment 11, further comprising another gage pad located at a third radial distance farther from the longitudinal axis than the second radial distance.

Embodiment 13: The earth-boring tool of Embodiment 12, wherein the at least one cutting element is located axially between the gage pad at the second radial distance and the other gage pad at the third radial distance.

Embodiment 14: The earth-boring tool of Embodiment 13, further comprising another cutting element located on an axial side of the other gage pad at the third radial distance opposite the at least one cutting element at the first radial distance.

Embodiment 15: The earth-boring tool of any one of Embodiments 11 through 14, further comprising another cutting element located on an axial side of the gage pad opposite the at least one cutting element located at the first radial distance from the longitudinal axis, the other cutting element located at a third radial distance closer to the longitudinal axis than the first radial distance.

Embodiment 16: A method of enlarging a pilot hole in an earth formation utilizing a reamer, comprising: enlarging a pilot hole by removing earth material from a sidewall of the pilot hole to form an enlarged borehole utilizing at least one cutting element located on a blade of a reamer, the at least one cutting element located at a first radial distance from a longitudinal axis of a body of the reamer; and stabilizing the reamer by placing a gage pad located on the blade of the reamer in sliding contact with a portion of the sidewall of the pilot hole, the gage pad located at a second, smaller radial distance from the longitudinal axis.

Embodiment 17: The method of Embodiment 16, wherein stabilizing the reamer further comprises placing another gage pad located on the blade of the reamer in sliding contact with a portion of the sidewall of the enlarged borehole, the other gage pad located at a third radial distance farther from the longitudinal axis than the second radial distance.

Embodiment 18: The method of Embodiment 17, further comprising back-reaming the enlarged borehole utilizing another cutting element located on an axial side of the other gage pad at the third radial distance opposite the at least one cutting element at the first radial distance.

Embodiment 19: The method of any one of Embodiments 16 through 18, further comprising clearing earth material from the sidewall of the pilot hole utilizing another cutting element located on an axial side of the gage pad opposite the at least one cutting element located at the first radial distance from the longitudinal axis, the other cutting element located at a third radial distance closer to the longitudinal axis than the first radial distance.

Embodiment 20: The method of any one of Embodiments 16 through 19, wherein placing the gage pad in sliding contact with the portion of the sidewall of the pilot hole comprises extending the blade from a retracted state to an extended state.

Embodiment 21: The method of Embodiment 20, further comprising placing the at least one cutting element in cutting engagement with another portion of the sidewall of the pilot hole located axially on a side of the gage pad opposite an earth-boring drill bit connected to the reamer by a drill string before placing the gage pad in sliding contact with the portion of the sidewall of the pilot hole.

While certain illustrative embodiments have been described in connection with the figures, those of ordinary skill in the art will recognize and appreciate that the scope of this disclosure is not limited to those embodiments explicitly shown and described in this disclosure. Rather, many additions, deletions, and modifications to the embodiments described in this disclosure may be made to produce embodiments within the scope of this disclosure, such as those specifically claimed, including legal equivalents. In addition, features from one disclosed embodiment may be combined with features of another disclosed embodiment while still being within the scope of this disclosure, as contemplated by the inventors.

What is claimed is:

1. A reamer for earth-boring applications, comprising:
a body having a longitudinal axis; and
a blade carried by the body, the blade comprising:
at least one cutting element located at a first radial distance from the longitudinal axis when the reamer is in an extended state;
a gage pad located at a second, smaller radial distance from the longitudinal axis, the second radial distance at least substantially extending to an outer gage of an earth-boring drill bit to be deployed with the reamer when the reamer is in an extended state; and
another gage pad located at a third radial distance farther from the longitudinal axis than the second radial distance when the reamer is in an extended state.

2. The reamer of claim 1, wherein the gage pad is located on an axial side of the at least one cutting element configured to be located closer to the earth-boring drill bit than the at least one cutting element when the reamer is connected to a drill string.

3. The reamer of claim 1, wherein the gage pad is positioned and configured to contact, and slide against, a sidewall of a pilot hole and the other gage pad is positioned and configured to contact, and slide against, a sidewall of an enlarged borehole.

4. The reamer of claim 1, wherein the at least one cutting element is located axially between the gage pad at the second radial distance and the other gage pad at the third radial distance.

5. The reamer of claim 4, further comprising another cutting element located on an axial side of the other gage pad at the third radial distance opposite the at least one cutting element at the first radial distance.

6. The reamer of claim 1, further comprising another cutting element located on an axial side of the gage pad opposite the at least one cutting element located at the first radial distance from the longitudinal axis, the other cutting element located at a third radial distance closer to the longitudinal axis than the first radial distance.

7. The reamer of claim 1, wherein the first radial distance is at least about 5% greater than the second radial distance.

8. The reamer of claim 1, wherein the blade is extensible from the body and retractable toward the body and the at least one cutting element does not extend beyond the body when the blade is in a fully retracted state.

9. The reamer of claim 1, wherein the at least one cutting element comprises a group of cutting elements having maximum radial exposures located between the first radial distance and the second radial distance.

10. An earth-boring tool, comprising:
an earth-boring drill bit comprising a gage region proximate an outer diameter of the earth-boring drill bit; and
a reamer connected to the earth-boring drill bit, the reamer comprising:
a body having a longitudinal axis; and
a blade carried by the body, the blade comprising:
at least one cutting element located at a first radial distance from the longitudinal axis when the reamer is in an extended state;
a gage pad located at a second, smaller radial distance from the longitudinal axis, the second radial distance at least substantially extending to the gage region of the earth-boring drill bit when the reamer is in an extended state; and
another gage pad located at a third radial distance farther from the longitudinal axis than the second radial distance when the reamer is in an extended state.

11. The earth-boring tool of claim 10, wherein the at least one cutting element is located axially between the gage pad at the second radial distance and the other gage pad at the third radial distance.

12. The earth-boring tool of claim 11, further comprising another cutting element located on an axial side of the other gage pad at the third radial distance opposite the at least one cutting element at the first radial distance.

13. The earth-boring tool of claim 10, further comprising another cutting element located on an axial side of the gage pad opposite the at least one cutting element located at the first radial distance from the longitudinal axis, the other cutting element located at a third radial distance closer to the longitudinal axis than the first radial distance.

14. A method of enlarging a pilot hole in an earth formation utilizing a reamer, comprising:
enlarging a pilot hole by removing earth material from a sidewall of the pilot hole to form an enlarged borehole utilizing at least one cutting element located on a blade of a reamer, the at least one cutting element located at a first radial distance from a longitudinal axis of a body of the reamer while the reamer is in an extended state;
stabilizing the reamer by placing a gage pad located on the blade of the reamer in sliding contact with a portion of the sidewall of the pilot hole, the gage pad located at a second, smaller radial distance from the longitudinal axis while the reamer is in an extended state; and
clearing earth material from the sidewall of the pilot hole utilizing another cutting element located on an axial side of the gage pad opposite the at least one cutting element located at the first radial distance from the longitudinal axis, the other cutting element located at a third radial distance closer to the longitudinal axis than the first radial distance while the reamer is in an extended state.

15. The method of claim 14, wherein stabilizing the reamer further comprises placing another gage pad located on the blade of the reamer in sliding contact with a portion of the sidewall of the enlarged borehole, the other gage pad located at a third radial distance farther from the longitudinal axis than the second radial distance.

16. The method of claim 15, further comprising back-reaming the enlarged borehole utilizing the other cutting element, the other cutting element being located on an axial side of the other gage pad at the third radial distance opposite the at least one cutting element at the first radial distance.

17. The method of claim 14, wherein placing the gage pad in sliding contact with the portion of the sidewall of the pilot hole comprises extending the blade from a retracted state to an extended state.

* * * * *